US007743801B2

(12) United States Patent
Janardhanam et al.

(10) Patent No.: US 7,743,801 B2
(45) Date of Patent: Jun. 29, 2010

(54) METHOD AND SYSTEM FOR DISPENSING ICE AND/OR A LIQUID

(75) Inventors: Ramesh Janardhanam, Louisville, KY (US); Natarajan Venkatakrishnan, Louisville, KY (US)

(73) Assignee: General Electric Company, Schenectady, NY (US)

( * ) Notice: Subject to any disclaimer, the term of this patent is extended or adjusted under 35 U.S.C. 154(b) by 626 days.

(21) Appl. No.: 11/647,830

(22) Filed: Dec. 29, 2006

(65) Prior Publication Data

US 2008/0156395 A1 Jul. 3, 2008

(51) Int. Cl.
*B65B 1/04* (2006.01)

(52) U.S. Cl. ..... 141/351; 141/83; 141/95

(58) Field of Classification Search ..... 141/83, 141/94, 95, 96, 192, 206, 351
See application file for complete search history.

(56) References Cited

U.S. PATENT DOCUMENTS

| | | | | |
|---|---|---|---|---|
| 4,917,155 | A * | 4/1990 | Koblasz et al. | 141/1 |
| 5,036,892 | A * | 8/1991 | Stembridge et al. | 141/1 |
| 5,551,598 | A | 9/1996 | Cutsinger | |
| 5,573,041 | A * | 11/1996 | Skell et al. | 141/1 |
| 5,743,106 | A | 4/1998 | Lee | |
| 6,170,273 | B1 * | 1/2001 | Bosi | 62/127 |
| 6,341,563 | B1 | 1/2002 | Gal et al. | |
| 6,344,642 | B1 | 2/2002 | Agam et al. | |
| 6,411,202 | B1 | 6/2002 | Gal et al. | |
| 6,417,602 | B1 | 7/2002 | Agam et al. | |
| 6,681,585 | B1 | 1/2004 | Stagg et al. | |
| 6,789,585 | B1 * | 9/2004 | Janke | 141/198 |
| 7,188,487 | B2 | 3/2007 | Choi | |
| 2007/0215239 | A1 * | 9/2007 | Dorney | 141/94 |
| 2007/0272019 | A1 * | 11/2007 | Agam et al. | 73/628 |

* cited by examiner

*Primary Examiner*—Gregory L Huson
*Assistant Examiner*—Jason K Niesz
(74) *Attorney, Agent, or Firm*—George L. Rideout, Esq.; Armstrong Teasdale LLP

(57) ABSTRACT

A touchless dispensing system includes a dispenser configured to dispense at least one of ice and at least one liquid. A detection device is positioned with respect to the dispenser. The detection device is configured to detect a container positioned with respect to the dispenser without contacting the container. The detection device is further configured to generate a signal confirming a position of the container with respect to the dispenser. The dispenser is activated to dispense an amount of ice and/or an amount of the at least one liquid into the container in response to the signal generated by the detection device.

21 Claims, 3 Drawing Sheets

METHOD AND SYSTEM FOR DISPENSING ICE AND/OR A LIQUID

BACKGROUND OF THE INVENTION

This invention relates generally to ice and/or liquid dispensers and, more particularly, to methods and systems for ice and/or liquid dispensers having a touchless detecting device.

Some conventional appliances, such as refrigerators, include a dispensing system having a storage tank for cooling and storing water, an ice maker, and a dispenser to dispense ice and/or water. The dispensing system dispenses ice and/or water upon actuating a lever located within a door of the refrigerator. The user physically touches or contacts the lever to exert a sufficient force to move the lever and actuate the dispensing system. Users may have difficulty actuating the lever. Additionally, ice and/or water is continuously dispensed as long as the lever is actuated. Users may not timely deactivate the lever and ice and/or water may undesirably spill from a container positioned with respect to the dispenser. Further, repeated contact with the lever may promote unsanitary conditions.

Some conventional dispensing systems include a detection device having an acoustic sensor that emits an acoustic pulse and receives an associated acoustic pulse as a result of an object reflecting the emitted acoustic pulse. The detection device then determines a position of the object based on the reflected acoustic pulse. However, the acoustic sensor cannot effectively detect an object positioned at a close proximity, such as within about 20 cm. Additionally, the acoustic pulse is radiated in a conical pattern at a distance greater than about 20 cm, which results in undesirable clutter and noise. As such, a plurality of acoustic sensors may be required for detecting an object beyond a distance of about 20 cm, which undesirably increases the number of components and/or the manufacturing cost.

BRIEF DESCRIPTION OF THE INVENTION

In one aspect, a touchless dispensing system is provided. The touchless dispensing system includes a dispenser configured to dispense ice and/or at least one liquid. A detection device is positioned with respect to the dispenser. The detection device is configured to detect a container positioned with respect to the dispenser without contacting the container. The detection device is further configured to generate a signal confirming a position of the container with respect to the dispenser. The dispenser is activated to dispense an amount of ice and/or an amount of the at least one liquid into the container in response to the signal generated by the detection device.

In another aspect, a refrigeration appliance is provided. The refrigeration appliance includes a cabinet defining at least one refrigeration compartment. A first door is coupled to the cabinet and movable between an open position and a closed position. In the closed position, the door is configured to sealingly enclose the at least one refrigeration compartment. The first door defines a recess. A dispenser is positioned within the cabinet. The dispenser is configured to dispense an amount of ice and/or an amount of a liquid into a container positioned within the recess. A detection device is positioned with respect to the recess. The detection device is configured to detect a container positioned within the recess without contacting the container. The detection device is further configured to generate a signal confirming a position of the container within the recess. A controller is in operational control communication with the detection device and the dispenser.

The controller is configured to activate the dispenser in response to a signal received from the detection device.

In still another aspect, a method for dispensing at least one of an amount of ice and an amount of liquid into a container is provided. The method includes providing a dispensing system including a housing defining a recess. A detection device is positioned with respect to the recess and a dispenser is positioned with respect to the recess. A container positioned within the recess is detected and a signal is generated confirming a position of the container within the recess. The dispenser is activated in response to the signal received from the detection device to dispense an amount of ice and/or an amount of liquid into the container.

DETAILED DESCRIPTION OF THE INVENTION

Figure 1:
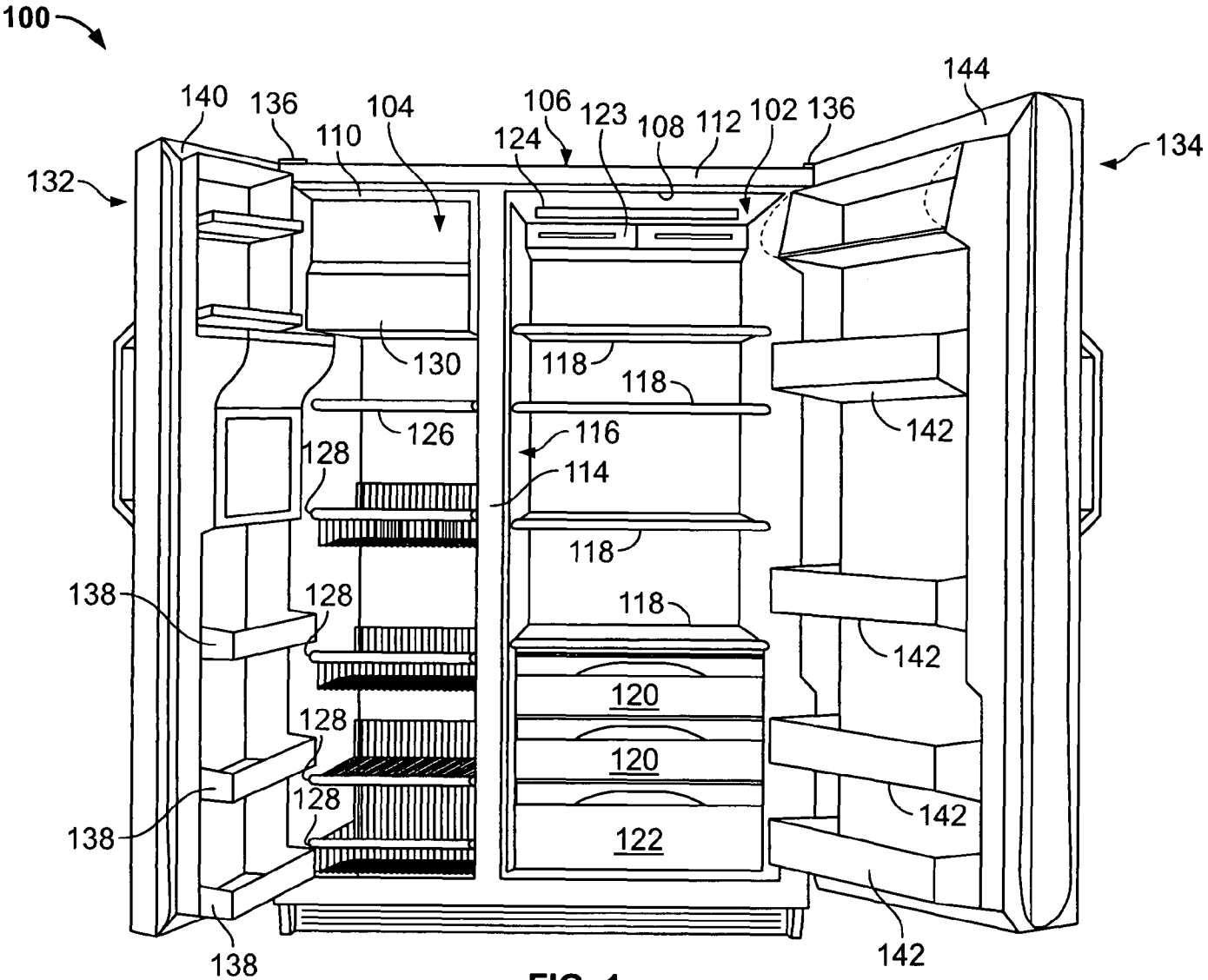
FIG. 1 is a perspective view of an exemplary refrigerator.

FIG. 1 is a perspective view of an exemplary refrigerator 100 in which exemplary embodiments of the present invention may be practiced and for which the benefits of the invention may be realized. Refrigerator 100 includes a fresh food storage compartment 102 and a freezer storage compartment 104. Fresh food compartment 102 and freezer storage compartment 104 are arranged side-by-side.

It should be apparent to those skilled in the art and guided by the teachings herein provided that the described methods and apparatus may likewise be practiced with alternative appliances, with suitable modification. Therefore, refrigerator 100 as described and shown herein is for illustrative purposes only and is not intended to limit the herein described methods and apparatus.

Fresh food storage compartment 102 and freezer storage compartment 104 are arranged side-by-side and contained within an outer case 106 and inner liners 108 and 110. A space between outer case 106 and inner liners 108 and 110, and between inner liners 108 and 110, is filled with foamed-in-place insulation. Outer case 106 normally is formed by folding a sheet of a suitable material, such as pre-painted steel, into an inverted U-shape to form top and side walls of outer case 106. A bottom wall of outer case 106 normally is formed separately and attached to the case side walls and to a bottom frame that provides support for refrigerator 100. Inner liners 108 and 110 are molded from a suitable plastic material to form fresh food storage compartment 102 and freezer storage compartment 104, respectively. Alternatively, inner liners 108 and 110 may be formed by bending and welding a sheet of a suitable metal, such as steel. The illustrative embodiment includes two separate inner liners 108 and 110 as it is a relatively large capacity unit and separate liners add strength and are easier to maintain within manufacturing tolerances. In smaller refrigerators, a single liner is formed and a mullion spans between opposite sides of the liner to divide it into a freezer storage compartment and a fresh food storage compartment.

A breaker strip 112 extends between a case front flange and outer front edges of inner liners 108 and 110. Breaker strip 112 is formed from a suitable resilient material, such as an extruded acrylo-butadiene-styrene based material (commonly referred to as ABS).

The insulation in the space between inner liners 108 and 110 is covered by another strip of suitable resilient material, which also commonly is referred to as a mullion 114. Mullion 114 also preferably is formed of an extruded ABS material. Breaker strip 112 and mullion 114 form a front face, and extend completely around inner peripheral edges of outer case 106 and vertically between inner liners 108 and 110. Mullion 114, insulation between compartments, and a spaced wall of liners separating compartments, sometimes are collectively referred to herein as a center mullion wall 116.

Shelves 118 and slide-out drawers 120 normally are provided in fresh food storage compartment 102 to support items being stored therein. A storage assembly 122 is provided in a lower portion of fresh food storage compartment 102, and is selectively controlled, together with other refrigerator features, by a controller 123 according to user preference via manipulation of a control interface 124 mounted in an upper region of fresh food storage compartment 102 and coupled to controller 123. In addition, at least one shelf 126 and at least one wire basket 128 are also provided in freezer storage compartment 104. In alternative embodiments, a position of storage assembly 122, controller 123, and/or control interface 124 is varied in alternative embodiments.

Controller 123 is mounted within refrigerator 100, and is programmed to perform functions described herein. As used herein, the term controller is not limited to just those integrated circuits referred to in the art as microprocessor, but broadly refers to computers, processors, microcontrollers, microcomputers, programmable logic controllers, application specific integrated circuits, and other programmable circuits, and these terms are used interchangeably herein.

Figure 2:
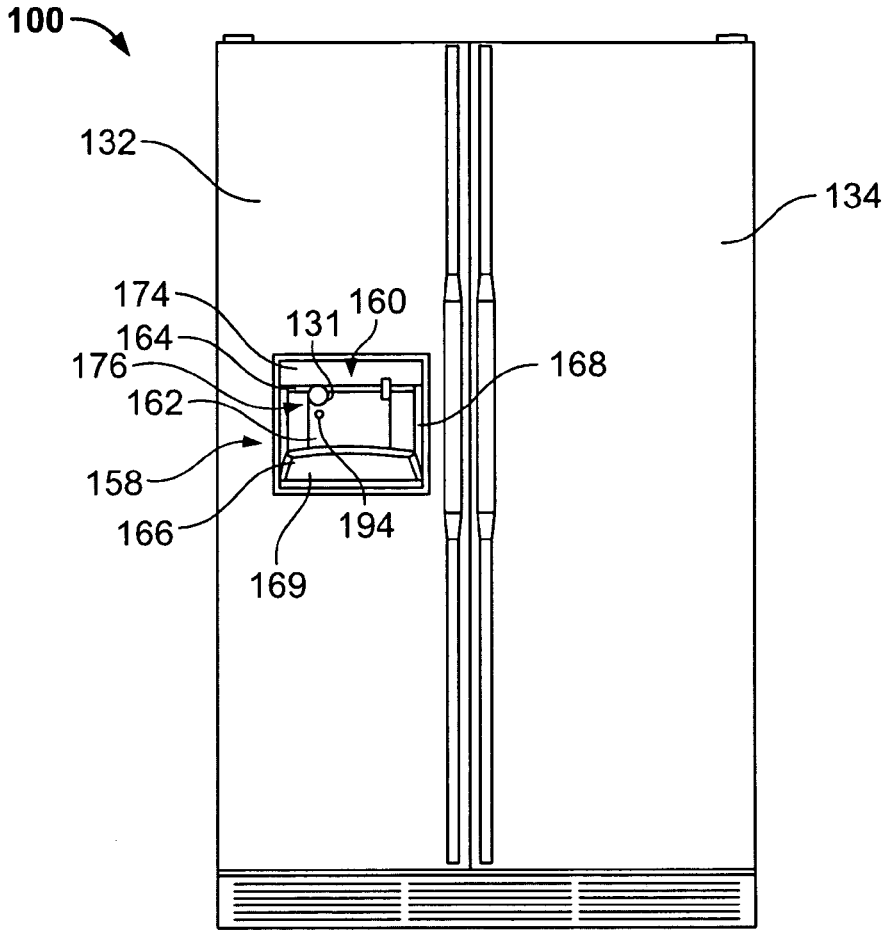
FIG. 2 is a front view of the refrigerator shown in FIG. 1 with a dispensing system.

In one embodiment, freezer storage compartment 104 includes an automatic ice maker 130 and a dispenser 131, shown in FIG. 2, provided in freezer door 132 such that ice and/or chilled water can be dispensed without opening freezer door 132. As will become evident below, ice maker 130, in accordance with conventional ice makers includes a number of electromechanical elements that manipulate a mold to shape ice as water freezes, a mechanism to remove or release ice from the mold, and a primary ice bucket for storage of ice produced in the mold. Periodically, the ice supply is replenished by ice maker 130 as ice is removed from the primary ice bucket. The storage capacity of the primary ice bucket is generally sufficient for normal use of refrigerator 100.

Freezer door 132 and a fresh food door 134 close access openings to freezer storage compartment 104 and fresh food storage compartment 102. Each door 132, 134 is mounted by a top hinge 136 and a bottom hinge (not shown) to rotate about its outer vertical edge between an open position, as shown in FIG. 1, and a closed position, as shown in FIG. 2, sealingly closing the associated storage compartment. Freezer door 132 includes a plurality of storage shelves 138 and a sealing gasket 140, and fresh food door 134 also includes a plurality of storage shelves 142 and a sealing gasket 144.

As with known refrigerators, refrigerator 100 also includes a machinery compartment (not shown) that at least partially contains components for executing a known vapor compression cycle for cooling air. The components include a compressor (not shown), a condenser (not shown), an expansion device (not shown), and an evaporator (not shown) connected in series and charged with a refrigerant. The evaporator is a type of heat exchanger which transfers heat from air passing over the evaporator to a refrigerant flowing through the evaporator, thereby causing the refrigerant to vaporize. The cooled air is used to refrigerate one or more refrigerator or freezer compartments via fans (not shown). Collectively, the vapor compression cycle components in a refrigeration circuit, associated fans, and associated compartments are referred to herein as a sealed system. The construction of the sealed system is well known and therefore not described in detail herein, and the sealed system is operable to force cold air through the refrigerator.

FIG. 2 is a front view of refrigerator 100 with doors 132 and 134 in a closed position. A recess 158 is defined on a front surface of freezer door 132, and a touchless dispensing system 160 is at least partially mounted on and/or within freezer door 132 and within recess 158.

In one embodiment, recess 158 includes a back wall 162, a top wall 164, a bottom wall 166 and two side walls 168 coupled, molded or integrated with each other. Bottom wall 166 defines a support surface 169 for supporting a container, such as, without limitation, a cup, pitcher or bowl, (not shown) positioned within recess 158. Dispensing system 160 includes dispenser 131 that extends into recess 158, such as through top wall 164 of recess 158. Dispenser 131 is configured to dispense ice and/or at least one liquid, such as chilled water, as desired. A user interface 174 is mounted on the front face of freezer door 132. Controller 123 (shown in FIG. 1) is coupled in operational control communication and/or signal communication with dispenser 131 and user interface 174. As such, controller 123 may operate dispenser 131 according to user selection through user interface 174. It should be apparent to those skilled in the art and guided by the teachings herein provided that dispenser 131 and/or user interface 174 may be mounted at any suitable position with respect to refrigerator 100 in alternative embodiments, such as on fresh food door 134.

A detection device 176 is mounted with respect to recess 158. In one embodiment, detection device 176 is mounted on or at least partially within back wall 162 of recess 158. Detection device 176 is configured to detect a container, such as a cup or other suitable container, positioned adjacent to or within recess 158 without contact between components of detection device 176 and the container. Upon detection of the container, detection device 176 generates a signal confirming a position of the container, and transmits the generated signal to controller 123. Controller 123 activates dispenser 131 in response to the signal received from detection device 176. It is apparent to those skilled in the art and guided by the teachings herein provided that detection device 176 may be mounted at any suitable position on or with respect to refrigerator 100 in alternative embodiments.

Figure 3:
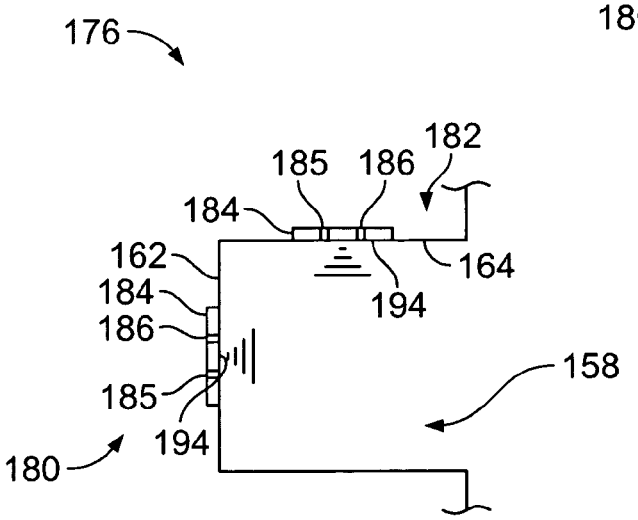
FIG. 3 is a schematic view of an exemplary dispensing system mounted within a recess defined by the refrigerator.

FIG. 3 is a schematic view of dispensing system 160 including detection device 176 mounted within recess 158. Device 176 includes a first detection assembly 180 and a second detection assembly 182, substantially identical in structure. In one embodiment, first detection assembly 180 and/or a second detection assembly 182 is configured to transmit and/or receive acoustic waves or signals.

First detection assembly 180 is mounted on or at least partially within back wall 162 of recess 158 and second detection assembly 182 is mounted on or at least partially within top wall 164 of recess 158. In one embodiment, each detection assembly 180, 182 includes an ultrasonic sensor module 184. Ultrasonic sensor module 184 includes a first ultrasonic sensor 185 configured to emit or transmit ultrasonic waves or signals into recess 158 and/or through recess 158 and a second ultrasonic sensor 186 configured to receive or detect ultrasonic waves or signals, such as ultrasonic waves or signals transmitted by ultrasonic sensor 185 and reflected or redirected by an object, such as a container positioned within recess 158. Detection assemblies 180, 182 detect an object (not shown) positioned within recess 158 and are in signal communication with controller 123 (shown in FIG. 1) to transmit a corresponding signal to controller 123. In an alternative embodiment, detection device 176 includes only first detection assembly 180 or second detection assembly 182.

Figure 4:
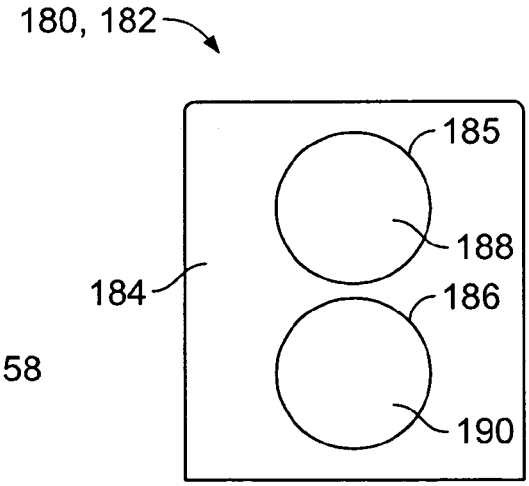
FIG. 4 is a schematic view of an exemplary ultrasonic sensor module suitable for use with the dispensing system.

FIG. 4 is a schematic view of an exemplary detection assembly 180 and/or 182 suitable for use with dispensing system 160. In one embodiment, ultrasonic sensor module 184 of each detection assembly 180, 182 includes at least one first ultrasonic sensor 185 and at least one second ultrasonic sensor 186 operatively coupled to controller 123.

In one embodiment, first ultrasonic sensor 185 includes an ultrasonic transmitter 188 and second ultrasonic sensor 186 includes an ultrasonic receiver 190. Ultrasonic transmitter 188 is energized or activated to periodically emit an ultrasonic signal, and ultrasonic receiver 190 receives a corresponding reflected ultrasonic signal, as described in greater detail below. In a particular embodiment, ultrasonic transmitter 188 and/or ultrasonic receiver 190 include at least one acoustic transducer, such as for example, at least one membrane acoustical-electrical transducer.

Figure 5:
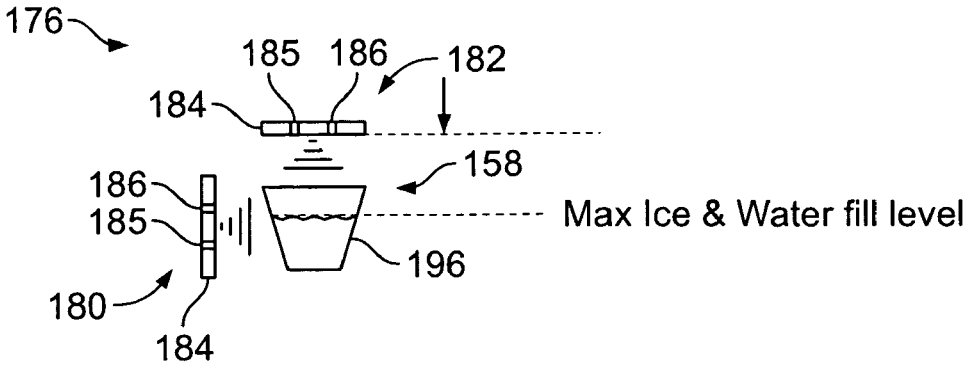
FIG. 5 is a schematic view of the dispensing system shown in FIG. 3 during a dispensing process.
Figure 6:
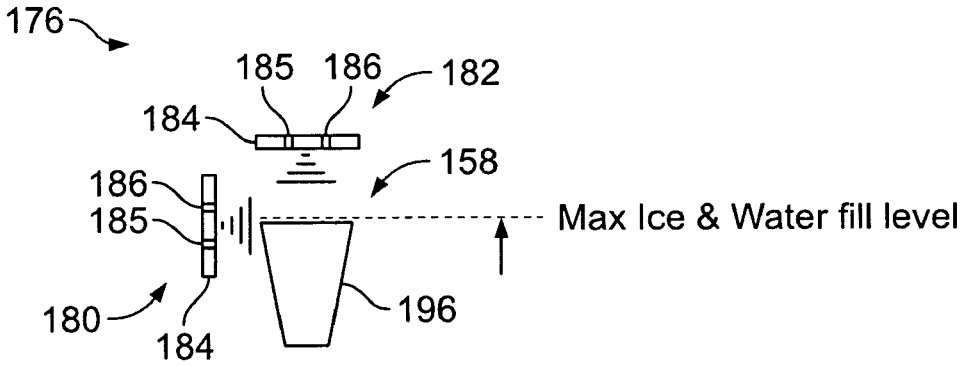
FIG. 6 is a schematic view of the dispensing system shown in FIG. 3 during a dispensing process.

FIGS. 5 and 6 illustrate an exemplary dispensing system 160 including detection device 176 during a dispensing process.

During an exemplary dispensing process, ultrasonic sensor module 184 of first detection assembly 180 mounted with respect to recess back wall 162 and/or ultrasonic sensor module 184 of second detection assembly 182 mounted with respect to recess top wall 164 periodically generates an ultrasonic signal. A detecting period may vary depending on required or desired detection accuracy. In one embodiment, ultrasonic transmitters 188 transmit ultrasonic signals into recess 158 through outlets 194 defined within back wall 162 and top wall 164, as shown in FIG. 3. When a container, such as a cup 196, is positioned adjacent or within recess 158, the ultrasonic signal is reflected and/or redirected by cup 196. The reflected and/or redirected signal is received or detected by ultrasonic receiver 190. Corresponding ultrasonic sensor module 184 processes or analyzes the returned or reflected ultrasonic signal to facilitate determining geometric information for cup 196. In a particular embodiment, controller 123, in operational control communication with ultrasonic sensor module 184, processes or analyzes the returned or reflected ultrasonic signal detected or sensed by ultrasonic sensor module 184 to determine geometric information for cup 196 based at least in part on data transmitted by ultrasonic sensor module 184.

TABLE 1

| Cup presence (detected by first detection assembly) | Maximum fill level (detected by second detection assembly) | Activation of dispenser |
|---|---|---|
| Yes | No | Yes |
| Yes | Yes | No |
| No | Yes | No |
| No | No | No |

As illustrated in Table 1 above, first detection assembly 180 detects a relative position of cup 196 with respect to recess 158. In one embodiment, first detection assembly 180 detects a distance of cup 196 with respect to back wall 162 of recess 158. In a particular embodiment, first detection assembly 180 is activated when cup 196 is positioned no more than about 1.0 cm from back wall 162. First detection assembly 180 is deactivated when cup 196 is positioned greater than about 1.5 cm from back wall 162. First detection assembly 180 also detects a relative height of cup 196 with respect to support surface 169 of recess 158. First detection assembly 180 detects that outlet 194 is covered when cup 196 substantially interferes with the acoustic signal transmitted therefrom. In a particular embodiment, outlet 194 is defined on or at least partially within back wall 162 and has a diameter of about 2.0 cm. As such, a height of cup 196 is detected when corresponding outlet 194 is substantially covered or blocked. Upon detecting the distance and the height, first detection assembly 180 determines the presence of cup 196. First detection assembly 180 communicates with controller 123 to activate dispenser 131.

During the exemplary dispensing process, second detection assembly 182 also detects a fill level of ice and/or liquid within cup 196. Second detection assembly 182 communicates with controller 123 to deactivate dispenser 131 upon detecting a fill level that approaches or reaches a selected maximum fill level. In a particular embodiment, the maximum fill level is set at a height equal to the height of outlet 194 defined on back wall 162. With cup 196 positioned at a height greater than the maximum fill level, dispenser 131 is activated. As such, liquid and/or ice is prevented from spilling from cup 196 during the dispensing process. In alternative embodiments, the maximum fill level may vary.

As shown in FIG. 5, controller 123 operates dispenser 131 in response to signals received from first detection assembly 180 and/or second detection assembly 182. When first detection assembly 180 and second detection assembly 182 communicate with controller 123 to activate dispenser 131, for example, by transmitting an appropriate signal to controller 123, controller 123 initiates activation of dispenser 131. Controller 123 deactivates dispenser 131 when the liquid level and/or the ice level within cup 196 approaches or reaches the maximum fill level. As shown in FIG. 6, controller 123 also deactivates dispenser 131 if first detection assembly 180 and/or second detection assembly 182 does not detect cup 196. In a particular embodiment, controller 123 deactivates dispenser 131 if cup 196 or another suitable container is not positioned within recess 158 such that outlet 194 of detection assembly 180 is uncovered.

In a further embodiment, first detection assembly 180 is configured to sense or detect a presence of an object, such as a person, positioned or standing in front of refrigerator 100. First detection assembly 180 accurately senses or detects a container positioned within recess 185 as well as an object, such as a person, at greater distances, for example, distances greater than about 20 mm.

Figure 7:
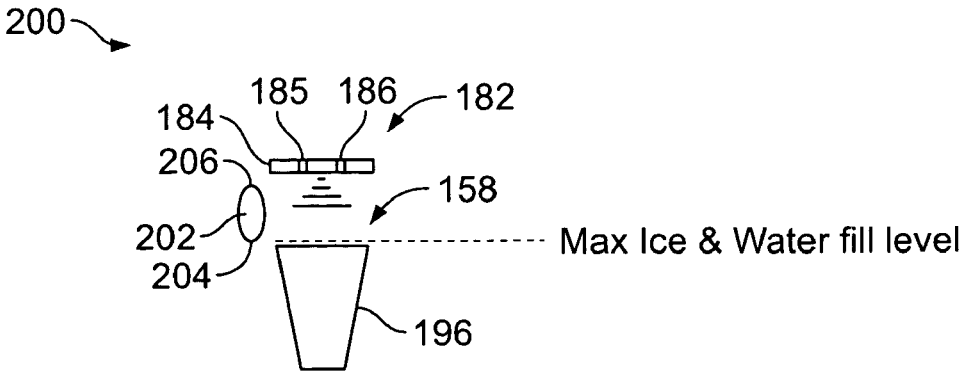
FIG. 7 is a schematic view of an alternative dispensing system mounted within a recess defined by the refrigerator.

FIG. 7 is a schematic view of an alternative detection device 200 mounted on or within recess 158. Detection device 200 includes only one detection assembly 182 and a biased paddle 202. The user pushes paddle 202 inwardly to activate dispenser 131 to dispense an amount of liquid and/or ice into cup 196. Detection assembly 182 detects a fill level within cup 196. Detection assembly 182 communicates with controller 123 (shown in FIG. 1) to deactivate dispenser 131 when the fill level reaches a selected maximum fill level. In a particular embodiment, the maximum fill level is set at a height equal to a height of a bottom edge or portion 204 of paddle 202. As such, the liquid and/or ice within cup 196 is below an opposing top edge 206 of cup 196 to prevent or limit spills.

In one embodiment, detection device 176 includes two detection assemblies, such as two ultrasonic sensor modules 184, positioned with respect to recess 185. Each ultrasonic sensor module 184 includes first ultrasonic sensor 185 including ultrasonic transmitter 188 configured to transmit ultrasonic signals into and/or through recess 158 and second ultrasonic sensor 186 including ultrasonic receiver 190 configured to receive ultrasonic signals. Detection device 176 is configured to detect a presence of a container, such as a cup, within recess 158 and a presence of an object, such as a person, positioned with respect to refrigerator 100, such as in front of touchless dispensing system 160. Thus, detection device 176 is configured to detect a container positioned within recess 158, a person standing in front of touchless dispensing system 160 and/or a level of liquid within the container during the dispensing process. With ultrasonic sensor module 184 configured such that ultrasonic transmitter 188 transmits ultrasonic signals and ultrasonic receiver 190 receives reflected or redirected ultrasonic signals, ultrasonic sensor module 184 accurately detects a position of an object to one-half of a wave length of a sound wave within recess 158 and to about one (1) meter outside recess 158.

The above-described method and system for dispensing an amount of chilled water and/or ice into a container positioned with respect to a dispenser facilitates accurately filling the container with chilled water and/or ice to a desired fill level while preventing or limiting spills. More specifically, the touchless dispensing system includes a detection device configured to detect a container positioned within a recess without contact between the detection device components and the container. The detection device is further configured to generate a signal confirming a position of the container within the recess to activate a dispenser to dispense an amount of chilled water and/or ice into the container in response to the generated signal. In a particular embodiment, the detection device is further configured to detect a fill level within the container. As a result, the touchless dispensing system accurately dispenses an amount of chilled water, or any suitable liquid, and/or ice into the container to a desired fill level without undesirable contact between the dispensing system components and the container, while preventing or limiting spills.

Exemplary embodiments of a method and system for dispensing an amount of chilled water and/or ice into a container positioned with respect to a dispenser are described above in detail. The method and system are not limited to the specific embodiments described herein, but rather, steps of the method and/or components of the system may be utilized independently and separately from other steps and/or components described herein. Further, the described method steps and/or system components can also be defined in, or used in combination with, other methods and/or systems, and are not limited to practice with only the method and system as described herein.

While the invention has been described in terms of various specific embodiments, those skilled in the art will recognize that the invention can be practiced with modification within the spirit and scope of the claims.

What is claimed is:

1. A touchless dispensing system comprising:

a dispenser configured to dispense at least one of ice and at least one liquid; and a detection device positioned with respect to a recess defined within a housing, wherein the recess comprises at least one wall, said detection device configured to detect a container positioned with respect to the dispenser without contacting the container and to detect a presence of a person positioned with respect to said dispenser, said detection device further configured to determine a distance between the container and said at least one wall and to determine a distance between the person and said at least one wall and to generate a signal confirming a position of the container with respect to the dispenser and confirming a position of the person with respect to said dispenser, said dispenser activated to dispense at least one of an amount of ice and an amount of the at least one liquid into the container in response to said signal generated by said detection device confirming the position of the container with respect to the dispenser and confirming the position of the person with respect to said dispenser.

2. A touchless dispensing system in accordance with claim 1 wherein said detection device further comprises at least one ultrasonic sensor module configured to transmit an ultrasonic signal and receive a corresponding reflected ultrasonic signal.

3. A touchless dispensing system in accordance with claim 2 wherein said ultrasonic sensor module further comprises an ultrasonic transmitter configured to transmit ultrasonic signals along a selected signal path and an ultrasonic receiver configured to receive ultrasonic signals.

4. A touchless dispensing system in accordance with claim 2 wherein said at least one ultrasonic sensor module further comprises a first ultrasonic sensor module configured to detect a relative position of the container with respect to said dispenser.

5. A touchless dispensing system in accordance with claim 4 wherein said at least one ultrasonic sensor module further comprises a second ultrasonic sensor module configured to detect a fill level within the container.

6. A touchless dispensing system in accordance with claim 1 further comprising a controller in operational control communication with said detection device and said dispenser, said controller configured to activate said dispenser in response to a signal received from said detection device.

7. A touchless dispensing system in accordance with claim 6 wherein said controller is configured to activate said dispenser with the container at a first position with respect to said detection device and deactivate said dispenser when said fill level reaches a maximum fill level.

8. A refrigeration appliance comprising:

a cabinet defining at least one refrigeration compartment;

a first door coupled to said cabinet and movable between an open position and a closed position, in the closed position said door configured to sealingly enclose said at least one refrigeration compartment, said first door comprising at least one wall defining a recess;

a dispenser positioned within said cabinet, said dispenser configured to dispense at least one of an amount of ice and an amount of a liquid into a container positioned within said recess;

a detection device positioned with respect to said recess, said detection device configured to detect a container positioned within said recess without contacting the container and configured to detect a presence of a person, said detection device further configured to:

determine a distance between the container and said at least one wall and a distance between the person and said at least one wall, and generate a signal confirming a position of the container within said recess and the presence of the person; and a controller in operational control communication with said detection device and said dispenser, said controller configured to activate said dispenser in response to a signal received from said detection device confirming the position of the container within said recess and the presence of the person.

9. A refrigeration appliance in accordance with claim 8 wherein said detection device further comprises at least one ultrasonic sensor module configured to transmit an ultrasonic signal and receive a corresponding returned ultrasonic signal redirected by the container.

10. A refrigeration appliance in accordance with claim 9 wherein said at least one ultrasonic sensor module further comprises a first ultrasonic sensor module configured to detect at least one of a distance of the container with respect to said detection device and a height of the container with respect to a support surface formed within said recess.

11. A refrigeration appliance in accordance with claim 9 wherein said at least one ultrasonic sensor module further comprises a second ultrasonic sensor module configured to detect a fill level within the container.

12. A refrigeration appliance in accordance with claim 11 wherein said controller is configured to deactivate said dispenser when the fill level reaches a maximum fill level.

13. A refrigeration appliance in accordance with claim 9 wherein said at least one ultrasonic sensor module further comprises an ultrasonic transmitter configured to transmit the ultrasonic signal into said recess.

14. A refrigeration appliance in accordance with claim 13 wherein said at least one ultrasonic sensor module further comprises an ultrasonic receiver configured to receive a redirected ultrasonic signal indicating the container positioned within said recess, said controller configured to initiate activation of said dispenser with the container substantially interfering with the transmitted acoustic signal.

15. A method for dispensing at least one of an amount of ice and an amount of liquid into a container, said method comprising:

providing a dispensing system comprising a housing having at least one wall defining a recess, a detection device positioned with respect to the recess, and a dispenser positioned with respect to the recess;

detecting a container positioned within the recess;

detecting a person positioned with respect to the dispensing system;

determining a distance between the container and the at least one wall;

determining a distance between the person and the at least one wall;

generating a signal confirming a position of the container within the recess and a position of the person; and activating the dispenser in response to the signal received from the detection device to dispense at least one of an amount of ice and an amount of liquid into the container, wherein the signal confirms the position of the container and the position of the person.

16. A method in accordance with claim 15 wherein said detecting a container positioned within the recess further comprises:

positioning at least one ultrasonic sensor module with respect to the recess;

operatively coupling the at least one ultrasonic sensor module with a controller;

transmitting an ultrasonic signal into the recess; and receiving a reflected ultrasonic signal through the ultrasonic sensor module.

17. A method in accordance with claim 16 wherein said positioning at least one ultrasonic sensor module with respect to the recess further comprises positioning a first ultrasonic sensor module with respect to the recess, the first ultrasonic sensor module configured to detect a fill level within the container.

18. A method in accordance with claim 17 further comprising de-deactivating the dispenser in response to a signal received from the first ultrasonic sensor module.

19. A method in accordance with claim 17 wherein said positioning at least one ultrasonic sensor module with respect to the recess further comprises positioning a second ultrasonic sensor module with respect to the recess, the second ultrasonic sensor module configured to detect a relative position of the container with respect to the recess.

20. A method in accordance with claim 19 further comprising activating the dispenser in response to a signal received from the second ultrasonic sensor module.

21. A method in accordance with claim 15 wherein, upon activating the dispenser to dispense at least one of ice and liquid into the container, said method further comprising detecting a level of the at least one of ice and liquid within the container.

* * * * *